US006926400B2

(12) United States Patent
Kelley

(10) Patent No.: US 6,926,400 B2
(45) Date of Patent: Aug. 9, 2005

(54) MEDIA INCISING PRINTER

(75) Inventor: Richard A. Kelley, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 33 days.

(21) Appl. No.: 10/286,210

(22) Filed: Oct. 31, 2002

(65) Prior Publication Data

US 2004/0085422 A1 May 6, 2004

(51) Int. Cl.[7] ..... B41J 11/66

(52) U.S. Cl. ..... 347/104; 400/621; 347/37; 346/24

(58) Field of Search ..... 234/35–37; 400/621; 347/2, 37, 101, 104

(56) References Cited

U.S. PATENT DOCUMENTS

| | | | | | |
|---|---|---|---|---|---|
| 3,951,252 | A | * | 4/1976 | Selke et al. | 400/621 |
| 4,604,032 | A | * | 8/1986 | Brandt et al. | 416/128 |
| 4,604,632 | A | * | 8/1986 | Matsumoto | 346/24 |
| 5,089,971 | A | * | 2/1992 | Gerber | 700/134 |
| 5,296,872 | A | * | 3/1994 | Caamano | 346/24 |
| 5,322,380 | A | * | 6/1994 | Crocker | 400/124.04 |
| 5,363,123 | A | * | 11/1994 | Petersen et al. | 346/24 |
| 5,882,128 | A | * | 3/1999 | Hinojosa | 400/593 |
| 6,117,061 | A | * | 9/2000 | Popat et al. | 493/325 |
| 6,151,037 | A | * | 11/2000 | Kaufman et al. | 347/2 |
| 6,217,167 | B1 | * | 4/2001 | Wen et al. | 347/101 |
| 6,270,215 | B1 | * | 8/2001 | Miyasaka et al. | 347/104 |
| 6,491,361 | B1 | * | 12/2002 | Spann | 347/2 |
| 6,554,511 | B2 | * | 4/2003 | Kwasny et al. | 400/621 |
| 6,599,044 | B2 | * | 7/2003 | Paris | 400/621 |
| 6,616,360 | B2 | * | 9/2003 | Lehmkuhl | 400/621 |
| 2003/0206211 | A1 | * | 11/2003 | Baron | 347/37 |

OTHER PUBLICATIONS

Inventor John M. Barron; Confirmation No. 5263; U.S. Appl. No. 10/139,911; filed May 6, 2002; Method and Apparatus for Scoring Media, Application as filed (40 pgs.).

Inventor John M. Barron; Confirmation No. 5263; U.S. Appl. No. 10/139,911; filed May 6, 2002; Method and Apparatus for Scoring Media, Filing Receipt mailed Jun. 24, 2002 (2 pgs.).

Inventor John M. Barron; Confirmation No. 5263; U.S. Appl. No. 10/139,911; filed May 6, 2002; Method and Apparatus for Scoring Media, Office Action mailed 3/10/20033 (12 pgs.).

Inventor John M. Barron; Confirmation No. 5263; U.S. Appl. No. 10/139,911; filed May 6, 2002; Method and Apparatus for Scoring Media, Transmittal Letter and Response/Amendment dated May 22, 2003 (9 pgs.).

Inventor John M. Barron; Confirmation No. 5263; U.S. Appl. No. 10/139,911; filed May 6, 2002; Methtod and Apparatus for Scoring Media, Office Action—Noncompliance mailed Jun. 5, 2003 (2 pgs.).

(Continued)

*Primary Examiner*—Stephen D. Meier
*Assistant Examiner*—Julian D Huffman

(57) ABSTRACT

A printer with a media incising device operably secured thereto and a related method for using the printer is disclosed. The media control device is in communication with a printer controller that commands the media incising device to engage the media. The disclosed incising devices include either mechanical structures that physically contact the media, or an incising fluid ejector that ejects incising fluid onto the media. Accordingly, the printer allows both printing on the media and incising, such as the creation of score lines, perforations, embossing, cutting, and the like, of the media without removing the media from the printer or requiring the use of two different machines to do these different tasks.

39 Claims, 8 Drawing Sheets

OTHER PUBLICATIONS

Inventor John M. Barron, Confirmation No. 5263; U.S. Appl. No. 10/139,911; filed May 6, 2002; Method and Apparatus for Scoring Media, Transmittal Letter and Response/Amendment dated Jun. 13, 2003 (12 pgs.).

Inventor John M. Barron; Confirmation No. 5263; U.S. Appl. No. 10/139,911; filed May 6, 2002; Method and Apparatus for Scoring Media, Office Action dated Jul. 8, 2003 (2 pgs.).

Inventor John M. Barron; Confirmation No. 5263; U.S. Appl. No. 10/139,911; filed May 6, 2002; Method and Apparatus for Scoring Media, Transmittal Letter and Response Amendment mailed Sep. 22, 2003 (12 pgs.).

Inventor John M. Barron; Confirmation No. 5263; U.S. Appl. No. 10/139,911; filed May 6, 2002; Method and Apparatus for Scoring Media, Notice of Publication of Application received Nov. 25, 2003 (1 pg.).

Inventor John M. Barron; Confirmation No. 5263; U.S. Appl. No. 10/139,911; filed May 6, 2002; Method and Apparatus for Scoring Media, Final Office Action dated Dec. 3, 2003 (8 pgs.).

Inventor John M. Barron, Confirmation No. 5263; U.S. Appl. No. 10/139,911; filed May 6, 2002; Method and Apparatus for Scoring Media, Transmittal and Response/Amendment mailed Jan. 29, 2004 (9 pgs.).

Inventor John M. Barron; Confirmation No. 5263; U.S. Appl. No. 10/139,911; filed May 6, 2002; Method and Apparatus for Scoring Media, Office Action—Advisory—dated Feb. 20, 2004 (3 pgs.).

Inventor John M. Barron; Confirmation No. 5263; U.S. Appl. No. 10/139,911; filed May 6, 2002; Method and Apparatus for Scoring Media, Request for Continued Examination mailed Mar. 4, 2004 (2 pgs.).

Inventor John M. Barron; Confirmation No. 5263; U.S. Appl. No. 10/139,911; filed May 6, 2002; Method and Apparatus for Scoring Media, Office Action dated May 18, 2004 (7 pgs.).

* cited by examiner

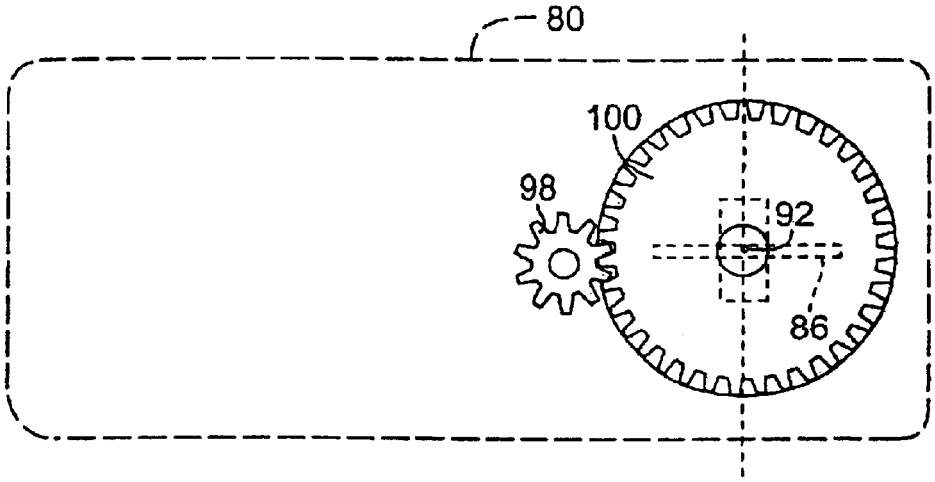
FIG. 5
FIG. 6
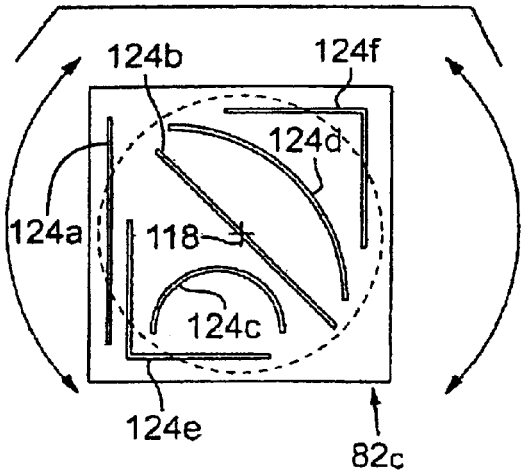
FIG. 7
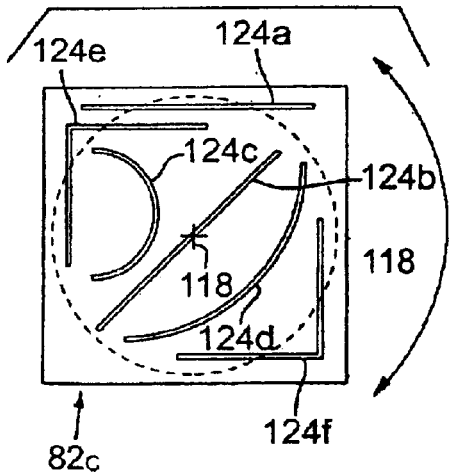

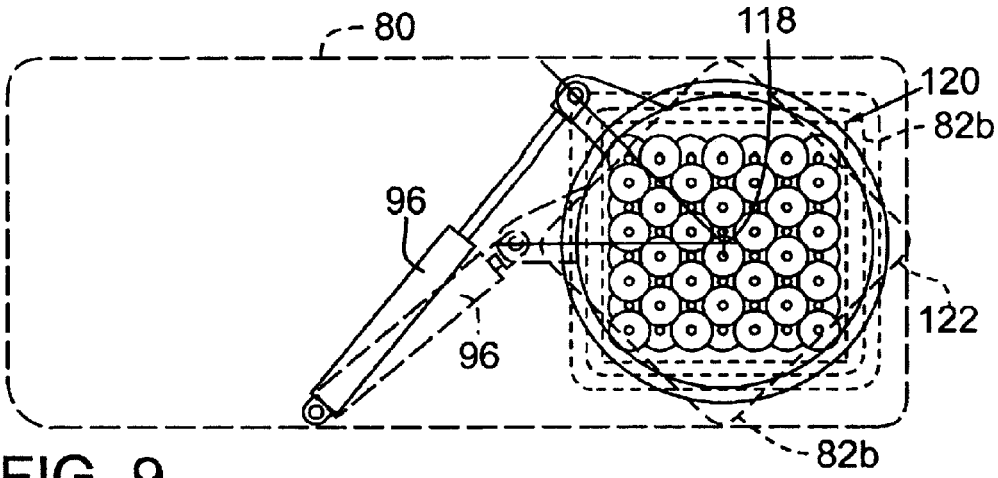
FIG. 9
FIG. 10
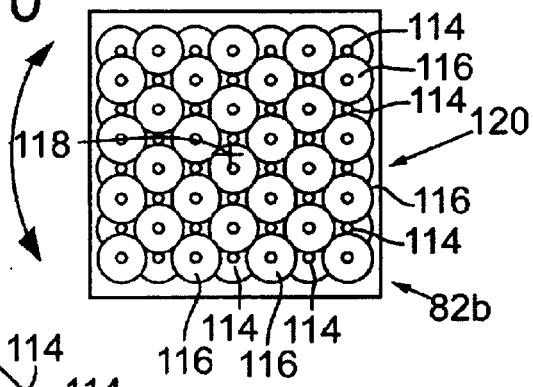
FIG. 11
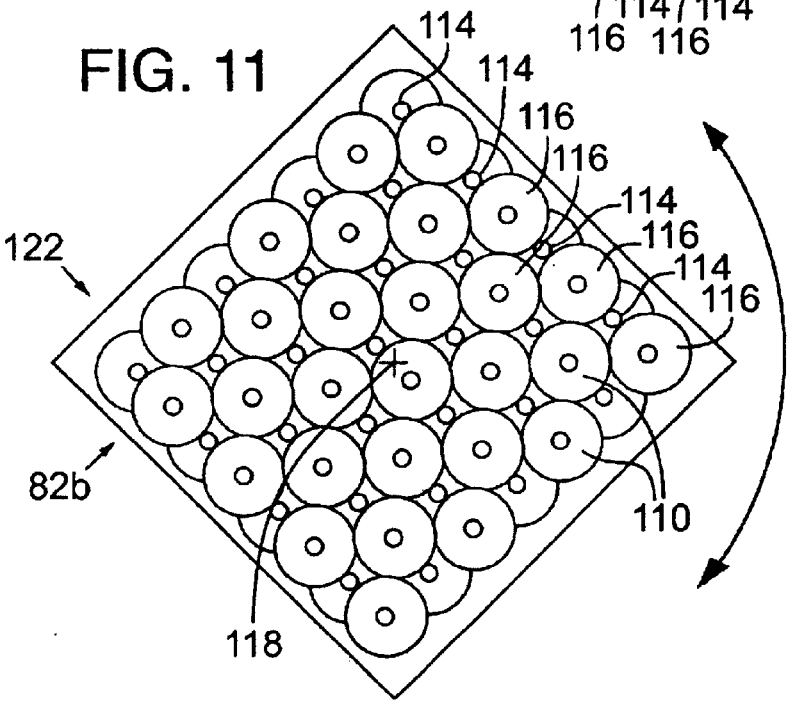

MEDIA INCISING PRINTER

TECHNICAL FIELD

This invention relates to a printer with one or more media incising devices attached thereto.

BACKGROUND OF THE INVENTION

Printed and incised media such as perforated media, scored media, cut media, and embossed media is widely used. For example, many creditors' statements include printed customer-related financial information and a perforated section containing printed customer identification information. The debtor usually detaches the perforated section from the statement and includes it when mailing payment to the creditor. Also, many checks are printed on perforated stock so they can be easily printed in a printer and then detached at the perforations after printing. Examples of common scored media include letters, which are folded to place in envelopes, brochures, and the like. Scoring heavy media is necessary to obtain a neat and clean fold. Similarly, embossed media, wherein all or a portion of the media is raised above the remaining portion of the media, is also quite popular. Examples of embossed media include invitations, business cards, and the like.

Usually, the processes of printing, cutting, embossing, perforating and scoring media are accomplished in different steps using different equipment. For example, check stock is usually manufactured by first printing the check on the media using a printer. Then, perforations are added to each check using a perforating machine. These processes are usually performed by a check manufacturer who then delivers a stack of sequentially numbered blank checks to an ordering customer. The customer uses each check by placing them one a time into a printer and printing specific financial information, such as the payee and amount, in appropriately identified spaces on the check.

Similarly, the process of embossing business cards, invitations, and the like usually requires printing information on the media using a printer, then embossing predefined places on that media using an embossing machine.

Brochure media and cover stock is either pre-scored before printing or scored after printing but before folding.

Small and economical printers are widely known and used. One particularly economical yet sophisticated printer is commonly known as an ink-jet printer. Ink-jet printers produce images and text on a page by firing drops of ink from the printheads of one or more ink cartridges secured to a carriage, while the carriage moves back and forth across the page. Examples of ink-jet printers include plotters, facsimile machines, and typical computer-attached ink-jet printers. The page on which a printer prints may be any sheet of media, such as paper, Mylar, foils, transparencies, card stock, check stock, and the like.

The ink supply of an ink-jet printer is limited. Thus, many cartridges are designed to be detachably secured and replaceable. A user simply replaces the old, empty ink cartridge with a new, full ink cartridge. In these so-called cartridge-type printers, the cartridges can be manufactured as a unit that includes a printhead and an ink reservoir (referred to as an "ink/printhead cartridge" herein). Thus, these types of ink/printhead cartridges are seated in a carriage that travels back and forth across the page during printing operation. Alternatively, the printhead can be secured to the carriage with the ink reservoir either attached at a separate location on the carriage and detachably secured to the printhead or positioned off the carriage with an ink tube extending to the printhead.

The ink head and carriage are in communication with a computer system that controls the movement of the carriage and the activation of the printhead to allow the printer to produce desired images and text on the media. The control system for these types of printers has become so precise, ink-jet printers can now reproduce extremely high print quality and even high-resolution photographs onto the media. The computer system usually includes a user interface, such as a word processing program or photograph display program, to assist user input of the desired image layout on the media.

A contributing factor in this improved precision is the ability to actuate very small actuators in the printhead. These printing actuators and related control systems can now be mass-produced inexpensively, leading to the affordable cost of the printer. Accordingly, complex and high quality printing, which previously could only have been performed by a printing company with large and expensive printing equipment, can now be performed by individuals and small businesses using only their personal computer and attached personal printer.

In contrast, despite the improvements in print quality and cost reductions of printers, there has been no similar improvement in media cutting, scoring, perforating, and embossing devices. This equipment has remained relatively bulky and expensive. Accordingly, such equipment is primarily limited to stationery and business form manufacturing companies. Few, if any, small and home businesses, invest in their own incising equipment. As a result, most individuals and businesses must order pre-incised media such as checks, business cards, and the like from these limited sources. Such pre-ordering needlessly increases the time and expense of using incised media.

SUMMARY OF THE INVENTION

Accordingly, despite the available improvements offered by today's printers, there remains a need for an affordable printer that also allows media incising such as scoring, embossing, perforating, cutting and the like. In addition to other benefits that will become apparent in the following disclosure, the present invention fulfills these needs.

The present invention is a printer with a media incising device operably secured thereto and a related method for using the printer. The media incising device is in communication with a printer controller that commands the media incising device to engage the media thereby incising it.

BRIEF DESCRIPTION OF THE DRAWINGS

FIG. 5 is a cross-sectional view of the carriage of FIG. 4 taken along lines 5—5 of FIG. 4.

FIG. 6 is a bottom view of an alternative cutting head for use on the incising cartridge of FIG. 4 showing the cutting head in a first possible position relative to the incising cartridge FIG. 7 is a bottom view of the alternative cutting head of FIG. 6 showing a second possible position relative to the incising cartridge.

FIG. 9 is a cross-sectional view of the incising cartridge of FIG. 8 taken along line 9—9 of FIG. 8.

FIG. 10 is a cross-sectional view of the incising cartridge of FIG. 8 taken along line 10—10 of FIG. 8 showing the incising head of the cartridge is a first possible position.

FIG. 11 is the cutting head of FIG. 10 in a second possible position.

DETAILED DESCRIPTION

A printer 20 having a carriage with a media incising device 22*a*–*c* attached thereto is shown in FIGS. 1–17. The incising device 22*a*, 22*b* can operate with one or more mechanical cutters, perforators, embossing elements, or scorers physically engaging the media such as by using structures shown in FIGS. 1–12. Alternatively, the incising device 22*c* can eject a liquid that interacts with the media to incise the media in a desirable manner as shown in FIGS. 13–17.

A. General Printer Assembly

Figure 1:
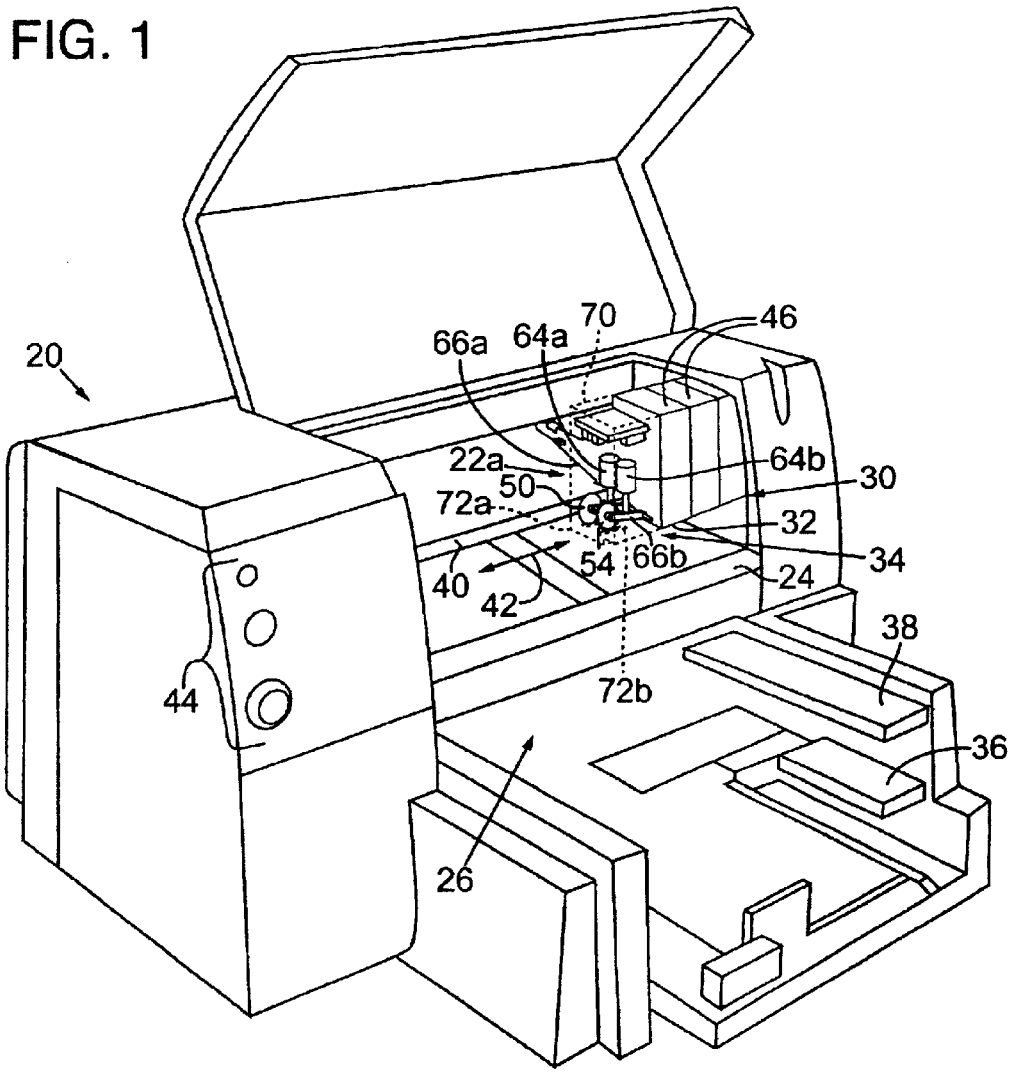
FIG. 1 is a simplified perspective view of an inkjet printer having a carriage containing an incising element thereon in accordance with an embodiment of the present invention.

FIG. 1 illustrates an embodiment of an inkjet printing mechanism, here shown as an inkjet printer 20, constructed in accordance with the present invention, which may be used for printing business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few. For convenience, the concepts of the present invention are illustrated in the environment of an inkjet printer 20.

While it is apparent that the printer components may vary from model to model, the typical inkjet printer 10, shown in FIG. 1, includes a chassis 24, a print medium handling system 26 for supplying sheets of print media 28 to the printer 20, and a movable print carriage 30 for moving printheads 32 relative to the media 28 at a print zone 34. The media 28 may be any type of suitable sheet material, such as paper, card-stock, transparencies, mylar, foils, and the like, but for convenience, the illustrated embodiment is described using paper as the print media 28. The print media handling system 26 moves the print media 28 into a print zone 34 from a feed tray 36 to an output tray 38, for instance, using a series of conventional motor-driven rollers (not shown).

In the print zone 34, the media 28 receives ink from a printhead 32. Each printhead 32 has a bottom surface comprising an orifice plate with a plurality of nozzles formed therethrough in a manner well known to those skilled in the art. The illustrated printheads 32 are thermal inkjet printheads, although other types of printheads may be used, such as piezoelectric printheads. The printheads 32 typically include a plurality of resistors that are associated with the nozzles. Upon energizing a selected resistor, a bubble of gas is formed ejecting a droplet of ink from the nozzle and onto a sheet of print media 28 in the print zone 34 under the nozzle.

The printheads 32 are transported by the carriage 30, which may be driven by a drive belt/pulley and motor arrangement (not shown) along a guide rod 40. The guide rod 40 defines a scanning direction or scanning axis 42 along which the printheads 32 traverse over the print zone 34. The printheads 32 selectively deposit one or more ink droplets on the media 28 located in the print zone 34 in accordance with instructions received via a conductor strip from a printer controller (not shown), such as a microprocessor, which may be located within the chassis 24. The printer controller may also receive an instruction signal from a host device, which is typically a computer, such as a personal computer. The printhead carriage motor and the paper handling system drive motor operate in response to the printer controller, which may operate in a manner well known to those skilled in the art. The printer controller may also operate in response to user inputs provided through a keypad 44. A monitor coupled to the host computer may be used to display visual information to an operator, such as the printer status or a particular program being run on the computer. Personal computers, their input devices, such as a keyboard and/or a mouse device, and monitors are all well known to those skilled in the art.

In particular, the print media 28 is fed from the feed tray 36 through a print medium feed mechanism (not shown). The print media 28 is then advanced by rollers (not shown) in a direction perpendicular to a guide rod 40, while the print carriage 30 containing printheads 32 is moved back and forth on guide rod 40. Preferably, and shown in FIG. 2, the carriage 30 contains at least one printhead 32 and at least one detachable ink reservoir 46 in fluid communication with that printhead. More preferably, both ink reservoir 46 and the printhead 32 are detachably secured to the printer 20 at respective mounting portions.

B. Mechanical Incising Devices

As shown in FIGS. 1–12, the carriage 30 preferably includes a media incising device 22*a*, 22*b* operably secured thereto.

For purposes of simplifying this discussion, the terms "incise" and "incising" media 28 collectively refer to physically altering the media 28 without necessarily applying ink to the media 28. Accordingly, unless specifically noted otherwise in this disclosure, the terms "incise" and "incising" include, but are not limited to, perforating the media, cutting the media, placing one or more score lines, which are also known as fold lines, on the media, and/or embossing the media such that a defined portion of it is permanently raised or lowered with respect to a base surface of the media.

Those skilled in the art can appreciate that the desired physical effect (perforating, cutting, score line creating, embossing, etc.) can be achieved by selecting an appropriate media engaging portion 48 for the incising device 22 to achieve the desired incising effect on the media 28. For example, to cut the media 28, the media engaging portion 48 can include a sharp blade 50 (FIG. 3A) for engaging the media 28. Similarly, to place a score line on the media the same incising device can include a blunt-tipped blade that engages the media 28. In order to prevent undue repetition, many of the embodiments disclosed herein disclose one particular type of media engaging portion. In can be appreciated that a particular embodiment can achieve a different incising effect simply by replacing the disclosed media engaging portion 48 with a different shaped or configured portion designed for the particularly desired incising effect.

1. Retractable Incising Disks

Figures 2, 3A, 3B:
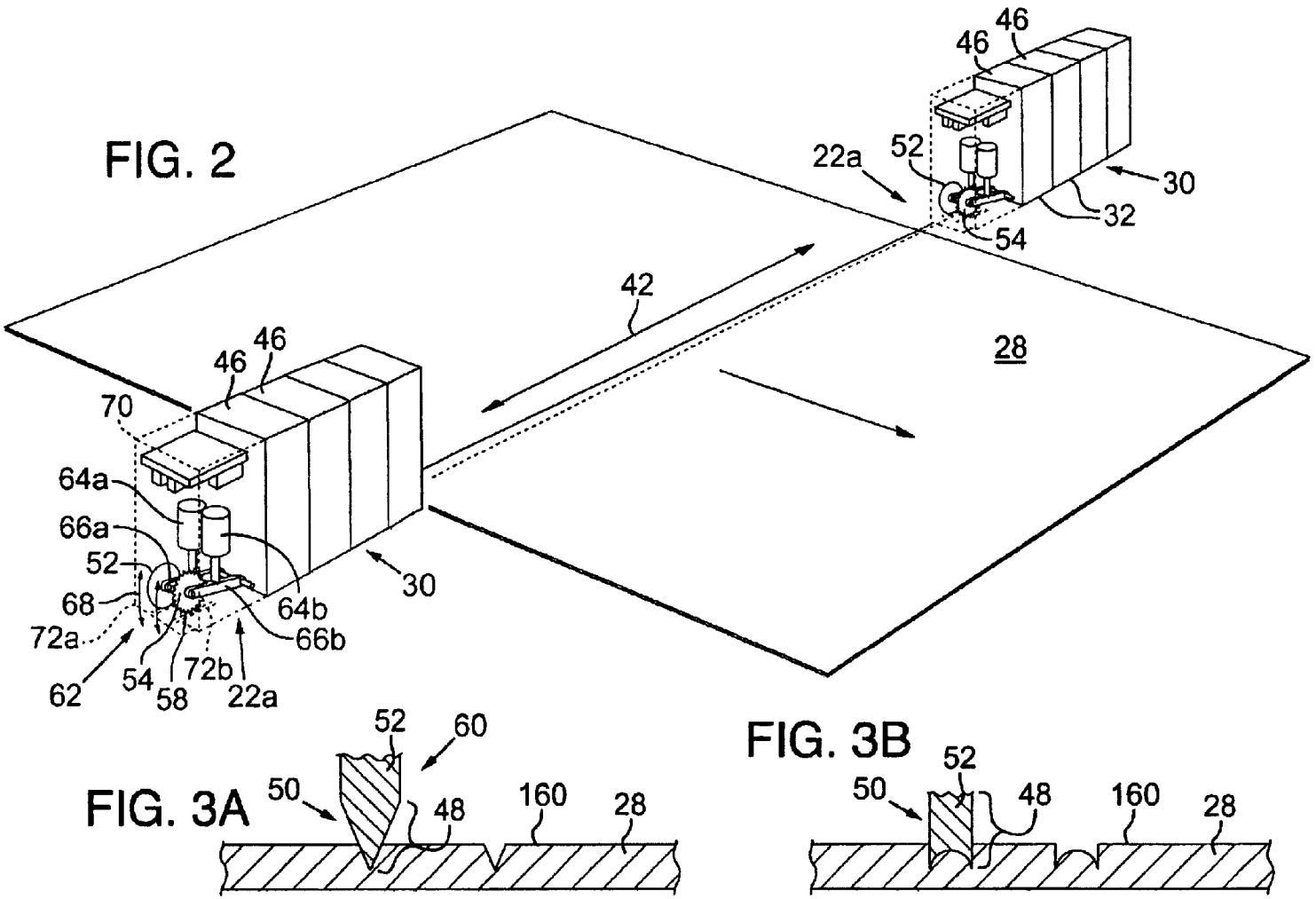
FIG. 2 is an isometric, schematic diagram of the carriage containing an incising element thereon of FIG. 1.
FIG. 3A is an enlarged, side view of an incising device in accordance with the embodiment shown in FIG. 2 showing a possible incising profile on a sheet of media.
FIG. 3B is an enlarged, side view of an alternative incising device in accordance with the embodiment shown in FIG. 2 showing an alternative possible incising profile on the sheet of media.

Referring to FIGS. 1 & 2, the incising device 22*a* preferably includes a retractable cutting disk 52 and a retractable perforating disk 54 operably secured to the carriage 30. The cutting disk 52 has a sharp blade 50 along its outer-diameter as shown in FIG. 3A for cutting the media 28. Alternatively, the cutting disk 52 can include a blunt outer diameter (not shown) or concave outer diameter as shown in FIG. 3B to facilitate making score lines on the media without cutting through the media. The perforating disk 54 has a plurality of spaced-apart protrusions 58 along its outer diameter for perforating the media 28. The disks 52, 54 are aligned parallel to the scanning axis 42 of the carriage 30, and the disks 52, 54 can be individually raised and lowered by the printer controller.

Each disk 52, 54 has an engaged position 60 (FIG. 3A) and a non-engaged position 62 (FIG. 2) relative to the media 28. The outer-diameter of each disk 52, 54 operably engage the media 28 to achieve a desired incising effect when the carriage 30 is commanded to move along the scanning axis 42 and the disk 52, 54 is the engaged position 60 (FIG. 3A). In the non-engaged position 62 the disk 52, 54 is raised off of the media 28.

Preferably, an electromechanical actuator 64*a*, 64*b* in communication with the print controller operably engages the disks 52, 54, respectively, to move the disks 52, 54 between their engaged and non-engaged positions. For example, as shown in FIG. 2, each disk 52, 54 is pivotally secured to one end of a pivoting arm 66*a*, 66*b*, respectively. The opposite ends of the arms 66*a*, 66*b* are pivotally secured to the carriage 30. An actuator 64*a*, 64*b*, respectively, such as linearly actuated servos, is connected to each arm 66*a*. 66*b* such that movement of the actuator 64*a*, 64*b* causes the respective arm 66*a*, 66*b* to pivot and thereby raise or lower the respective disk 52, 64 in the direction of arrows 68. The actuators 64*a*, 64*b* are in electrical communication with the printer controller and actuate on command and in conjunction with movement of the carriage 30 to produce a desired score line on the media 28.

It can be appreciated that a score line can be placed in the media 28 by using the sharp cutting disk 52 to protrude only slightly through the media as shown in FIG. 3A. Preferably, simply by controlling the level of penetration that the cutting disk protrudes through the media, the same cutting disk 52 can be used either to completely cut through the media or to create a score line in the media. More preferably, the cutting disk has two engaged positions, a cutting engaged position (not shown) in which the sharp outer diameter completely penetrates through the media, and a score line engaged position in which the sharp outer diameter penetrates only the upper portion of the media as shown in FIG. 3A.

A cut resistant material (not shown) may be positioned on the chassis 24 in the print zone 34 below the media 28 to prevent inadvertent and premature wear of the chassis 24 in this area caused by contact with the incising device 22*a*.

More preferably, the disks 52, 54 are received within in a case 70 (shown in broken lines in FIG. 2). The case 70 includes slots 72*a*, 72*b* through which the disks 52, 54, respectively, protrude in their engaged position. The disks 52, 54 retract into the case 70 in their non-engaged position 62, thereby preventing inadvertent injuries associated with inadvertent contact with one of the disks 52, 54.

2. Detachable Incising Cartridge

Referring to FIGS. 4–12, the incising device 22*b* includes a detachable incising cartridge 80 having different types of incising heads 82*a*–*d* is disclosed. The cartridge 80 includes a frame 84 having mounting portions sized and shaped to be detachably secured within a carriage mount of a printer. Accordingly, the incising cartridge 80 may be detachably secured to an existing printer cartridge mount. Moreover, the incising cartridge 80 can be installed into an existing, previously non-incising, printer thereby allowing the printer to operate as an incising device simply by removing one of the existing printer cartridges in the printer and temporarily replacing it with the incising cartridge 80.

The frame 84 includes electrical connectors that operably engage mating connectors on the carriage 30, thereby allowing incising elements therein to be in electrical communication with the printer controller. Each incising head 82*a*–*d* includes an actuated incising member that operably engages the media 28 to achieve the desired incising effect.

a. Rotating Incising Disk

Figure 4:
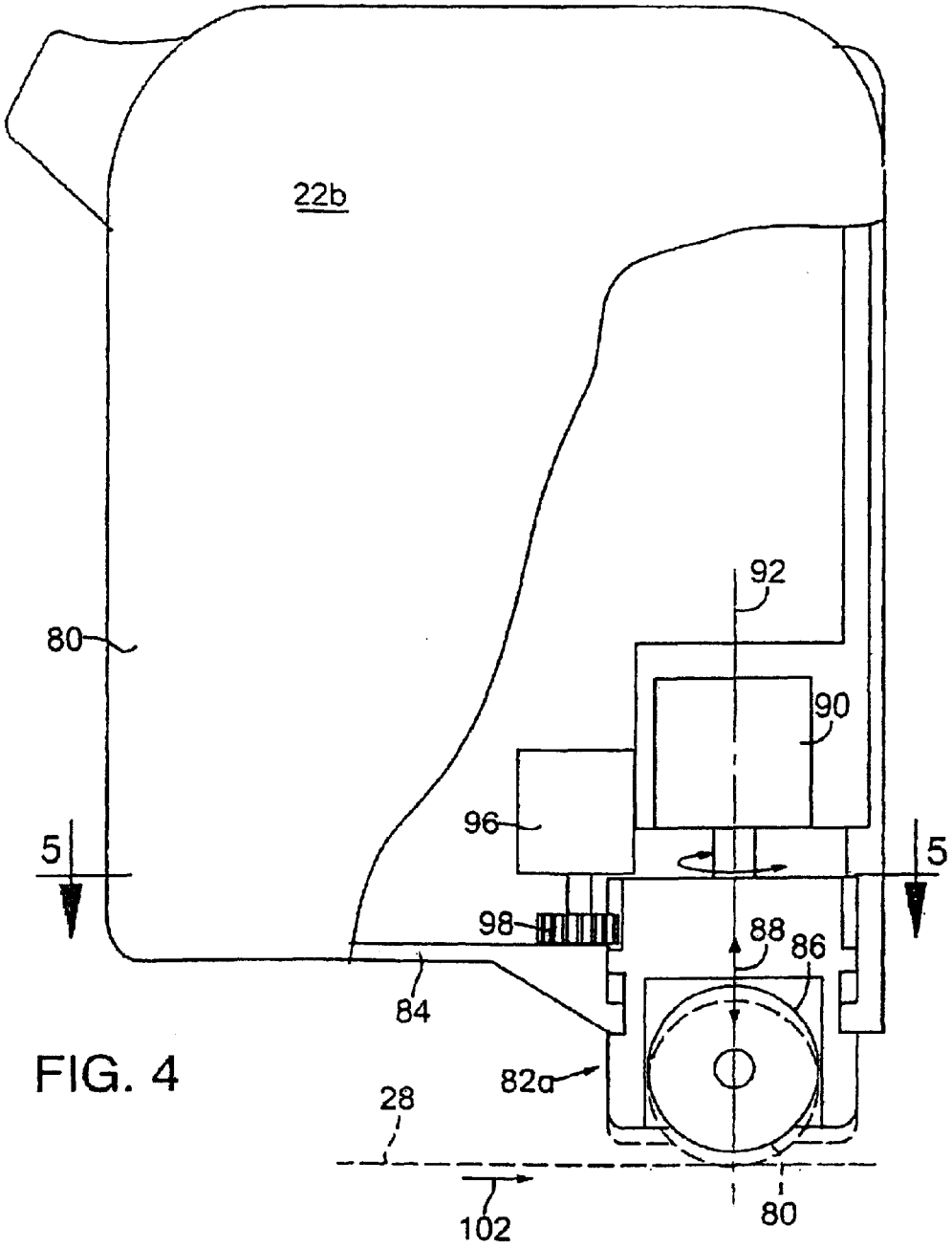
FIG. 4 is an enlarged side view of a carriage incising cartridge having a cutting head containing a circular cutter therein in accordance with an embodiment of the present invention.

Referring to FIG. 4, an incising head 82*a* having a rotating scoring disk 86 therein is disclosed. Preferably, the scoring disk 86 is operably secured to the head 82*a* such that it can raise and lower with respect to the case in the direction of arrows 88, thereby defining the engaged position 60 (shown in broken lines in FIG. 4) when the scoring disk 86 is down, and the non-engaged position 62 (shown in solid lines in FIG. 4) when the scoring disk 86 is up. Preferably, a vertical actuator 90 in communication with the printer controller raises and lowers the head 82*a* containing the scoring disk 86 as described.

More preferably, the head 82*a* is also rotatably secured to the frame 84 such that the position of the scoring disk 86 can turn about the longitudinal centerline 92 of the head 82*a*. For example and as shown in FIG. 4, the head 82*a* can be pivotally secured to the frame 84 and a head rotation actuator 96 on the frame 84 and in communication with the printer controller can rotate the head 82*a*. As best shown in FIG. 5, the head rotation actuator 96 preferably includes a sprocket 98 that mating engages a sprocket 100 on the head 82*a* to rotate the head 82*a* as described.

With appropriately timed rotation of the head 82*a*, raising and lowering the head 82*a* provided by the vertical actuator 90, movement of the carriage 30 along its scanning axis 42, and the movement of the media 28 along its media path 102, it can be appreciated that scoring disk 86 can provide any desired horizontal, vertical, angular, and circular scoring on the media 28. Preferably, the printer controller includes control logic for actuating these elements in the appropriate sequence to accomplish the desired scoring effect.

b. Retractable Incising Pins

Figure 8:
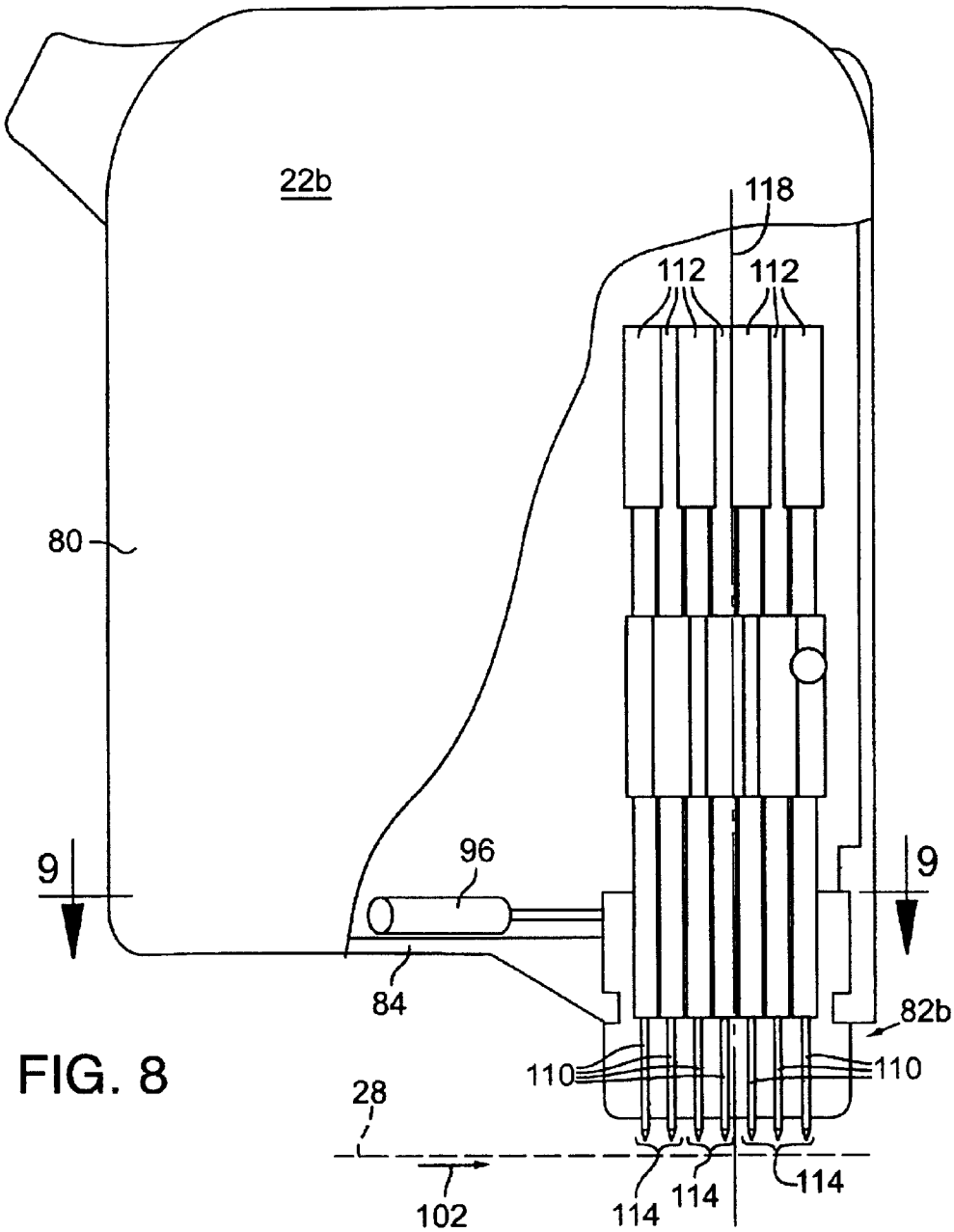
FIG. 8 an enlarged side view of a carriage incising cartridge having a plurality of retractable pin-type incising elements therein in accordance with an embodiment of the present invention.

Referring to FIG. 8, an incising head 82*b* having a plurality of retractable incising pins 110 is disclosed.

Preferably, the pins 110 are in a matrix pattern, and each pin 110 includes a pin actuator 112 in communication with the printer controller, thereby making each pin 110 independently operable.

Each pin 100 has an engaged position wherein it extends from the head 82*b* to operably engage the media 28, and a non-engaged position 62 (shown in FIG. 8) wherein the pin 110 is retracted within the head 82*b*. Preferably, the plurality of pins 10*b* include a set of pins having piercing tips 114 that pierce the media 28 in their respective pin's engaged position. Also, the plurality of pins include a set of pins having blunt or flat heads 116 that compress the media in their respective pin's engaged position. Each pin 110 in the set of pins having piercing tips 114 are spaced apart from each other, and each pin in the set of pins having blunt or flat heads 116 are spaced apart from each other as best shown in FIG. 11.

More preferably, the incising head 82*b* containing the plurality of pins 110 is also pivotally secured to the frame 84 such that the head 82*b* can turn about a substantially vertical axis 118. For example and as shown in FIG. 9, a head rotation actuator 96 in communication with the printer controller pivots the head 82*b* between a first position 120 (also shown in FIG. 10) and a second position 122 (shown in broken lines in FIG. 9 and also shown in FIG. 11).

With appropriately timed pivoting of the head 82*b*, raising and lowering specific pins 110 on the head 82*b*, movement of the carriage 30 along its scanning axis 42, and the movement of the media 28 along its media path 102, it can be appreciated that the incising head 82*b* can provide any desired horizontal, vertical, angular, and circular scoring on the media 28 including perforation lines, complex aperture shapes, and the like. Moreover, the plurality of blunt headed pins also allows complex embossing patterns to be imprinted into the media. Preferably, the printer control includes control logic for actuating these elements in the appropriate sequence to accomplish these and other desired scoring effects.

Where a plurality of print cartridges are also provided on the carriage 30, the printer 20 can simultaneously print on the media 28 and incise the media as the carriage 30 travels along its scanning axis 42, thereby saving time.

c. Shaped Incising Blades

Referring to FIGS. 6 & 7, an alternative incising head 82*c* is disclosed. This embodiment includes a plurality of individually actuatable, retractable incising pins 110 (FIG. 8) operably secured to a pivoting head as with the previous embodiment. However, the tips of the pins drive different shaped incising blades 124*a–f*. For example, a straight blade 124*a*, an angled blade 124*b*, a half-circular shaped blade 124*c*, a curved blade 124*d*, a left corner blade 124*e*, and a right corner blade 124*f* are shown.

Each blade 124*a–f* is individually actuatable to operably engage the media 28 when the respective pin 110 associated with that blade i124*a–f* is commanded to its engaged position. Preferably, the blades 124*a–f* are biased to a neutral, non-engaged position, wherein the blades 124*a–f* are retracted within the head 82*c*.

More preferably, the head 82*c* containing the plurality of blades 124*a–f* is also pivotally secured to the frame 84 such that the head 82*c* can turn about a substantially vertical axis 118. For example, a head rotation actuator 96 in communication with the printer controller pivots the head 82*c* between a first position 120 (FIG. 6) and a second position 122 (FIG. 7). Accordingly, with the head 82*c* pivoted to a desired position, the blades 124*a–f* may be commanded in a desired sequence to incise the media 28 in a wide variety of shapes and contours. Moreover, tips of the individual blades may be either shaped to pierce the media 28 or compress the media, thereby allowing the incising head 82*c* to cut, score, perforate, and emboss the media as desired.

With appropriately timed pivoting of the head 82*c*, raising and lowering of specific blades 124*a–f*, movement of the carriage 30 along its scanning axis 42, and the movement of the media 28 along its media path 102, it can be appreciated that incising head 82*c* can provide any desired horizontal, vertical, angular, and circular incising on the media including perforation lines, complex aperture shapes, and the like. Preferably, the printer control includes control logic for actuating these elements in the appropriate sequence to accomplish these and other desired incising effects.

d. Rotating Incising Bit

Figure 12:
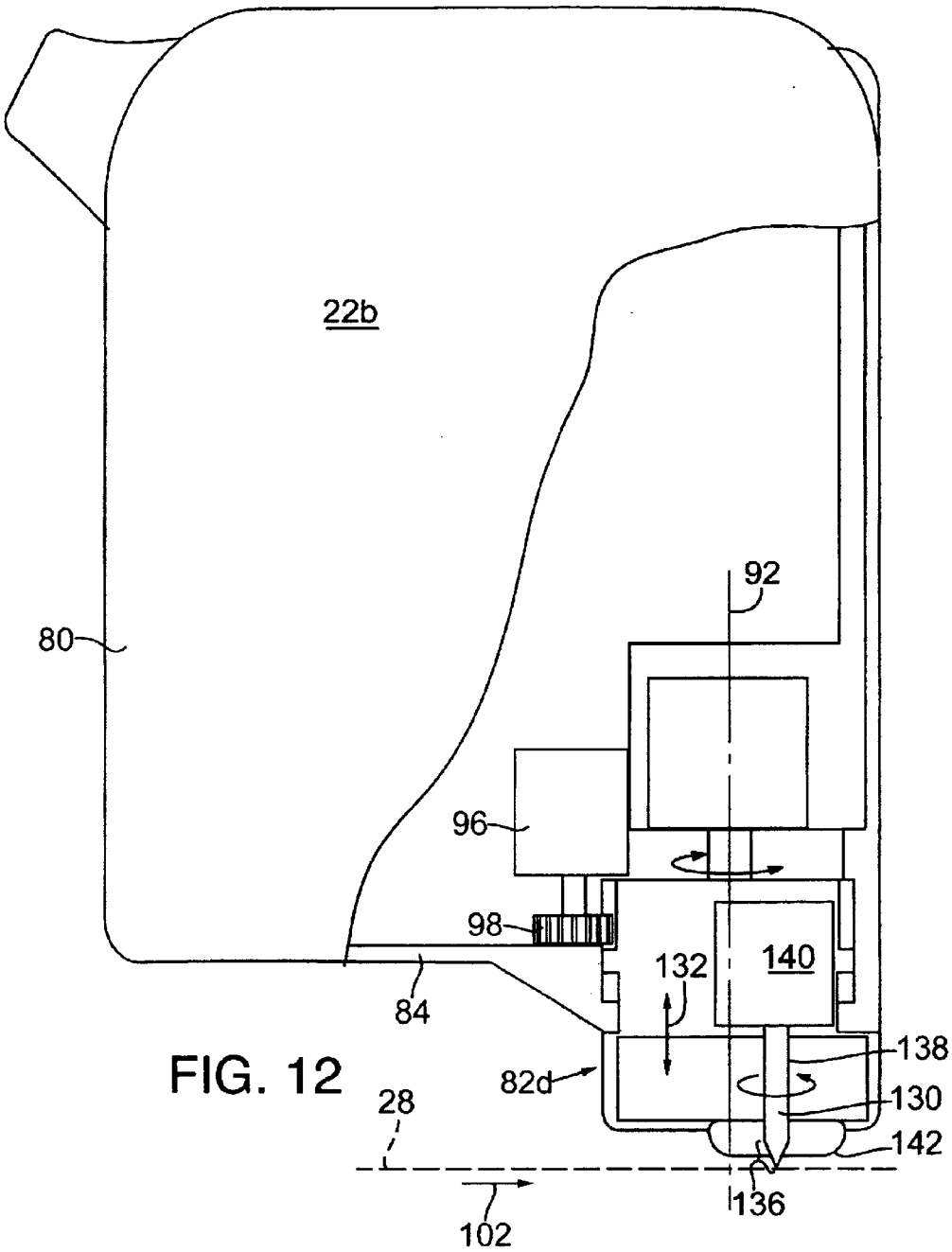
FIG. 12 is an enlarged side view of a carriage incising cartridge having an incising head containing a rotary bit therein in accordance with an embodiment of the present invention.
Figure 13:
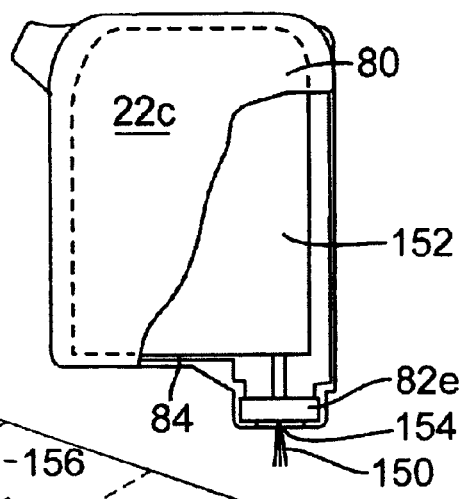
FIG. 13 is an enlarged side view of a carriage incising cartridge having a liquid ejecting incising head thereon in accordance with an embodiment of the present invention.
Figure 14:
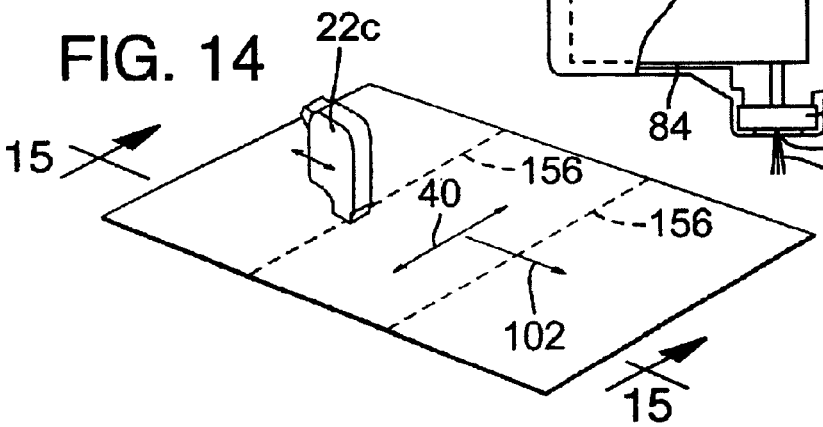
FIG. 14 is an isometric, schematic diagram of the carriage containing a carriage incising cartridge of FIG. 13 showing a possible incising orientation on a sheet of media.

Referring to FIG. 12, an incising head 82*d* having a rotating incising bit 130 therein is disclosed. Preferably, the bit 130 is operably secured to the head 82*d* such that it can raise and lower with respect to the frame in the direction of arrows 132, thereby defining the engaged position 60 (shown in FIG. 12) when the bit 130 is down, and the unengaged position when the bit 130 is up. Preferably, a vertical actuator 90 in communication with the printer controller raises and lowers the head 82*d* containing the bit 130 as described.

The bit 130 includes a pointed tip 136 and an appropriate cutting surface 138. A motor 140 in communication with the printer controller rotates the bit 130 at a sufficient speed to incise the media 28 as needed. Alternatively, the tip 136 of the bit 136 is blunt and the engaged position 60 includes a score line position wherein the blunt tip of the bit 130 compresses, but does not pierce the media 28. Accordingly, the incising head 82*d* can cut or create a perforated line along the media by piercing the media and moving the cutting surface 138 of the bit 130 along a defined path or the incising head 82*d* can place a score line in the media 28 by placing the bit 130 in the score line position and moving the bit along the media 28 in a defined path. A guard 142 extends from the head 82*d* to protect inadvertent impact of the bit 130.

More preferably, the bit 130 is mounted off center from the longitudinal centerline 92 of the head 82*d*, and the head 82*d* is also rotatably secured to the frame 84 such that the position of the bit 130 can turn about the longitudinal centerline 92 of the head 82*d*. For example and as shown in FIG. 12, the head 82*d* can be pivotally secured to the frame 84 and a head rotation actuator 96 on the frame 84 and in communication with the printer controller can rotate the head 82*d*. As best shown in FIG. 5, the head rotation actuator 96 includes a sprocket 98 that matingly engages a sprocket 100 on the head 82*d* to rotate the head as described. This rotation of the bit about the longitudinal centerline of the head 82*d* allows circular and curved shaped apertures, score lines, and perforations to be placed in the media 28 without necessarily moving the media 28 along its media path 102.

With appropriately timed rotation of the head 82*d*, raising and lower the bit 130, movement of the carriage 30 along its scanning axis 42, and the movement of the media 28 along its media path 102, it can be appreciated that the incising bit 1130 can provide any desired horizontal, vertical, angular, and circular incising on the media. Preferably, the printer control includes control logic for actuating these elements in the appropriate sequence to accomplish these and other desired incising effects.

Moreover, where at least one print cartridge is also provided on the carriage 30, the printer 20 can simultaneously print on the media 28 and incise the media 28 as the carriage 30 travels along its scanning axis 42, thereby saving time, and not requiring the user to use two different devices to accomplish both tasks.

C. Fluid Ejector Incising Device

Referring to FIGS. 13–17, an incising device 22*c* that ejects incising fluid 150 onto a sheet of media 28 is disclosed. The incising device 22*c* preferably includes a detachable incising cartridge 80 forming a frame 84 having mounting portions sized and shaped to be detachably secured within an existing carriage mount of a printer 20. Accordingly, the cartridge 80 may be detachably secured to the carriage 30. Moreover, the incising cartridge 80 can be installed into an existing, previously non-incising, printer thereby allowing the printer to operate as an incising device simply by removing one of the existing printer cartridges in the printer and temporarily replacing it with the incising cartridge 80.

The incising frame 84 includes electrical connectors that operably engage mating connectors on the carriage 30, thereby allowing incising elements therein to be in electrical communication with the printer controller.

The cartridge 80 also includes an incising fluid reservoir 152 containing the incising fluid 150 therein. The incising fluid reservoir 152 is in fluid communication with a fluid ejecting incising head 82*e*. The fluid ejecting incising head 82*e*, which is in communication with the printer controller, ejects incising fluid 150 therethrough on command of the printer controller.

Similar to an ink jet printer print head, the fluid ejecting incising head 82*e* preferably has a bottom surface comprising an orifice plate with a plurality of nozzles formed therethrough in a manner well known to those skilled in the art. The illustrated fluid ejecting incising head 82*e* is more commonly used as a thermal inkjet printhead, although other types of incising head may be used, such as piezoelectric printheads. The fluid ejecting incising head 82*e* typically includes a plurality of resistors that are associated with the nozzles 154. Upon energizing a selected resistor, a bubble of gas is formed ejecting a droplet of incising fluid 150 from the nozzle 154 and onto the media 28 in the print zone 34 under the nozzle 154.

Figure 15:
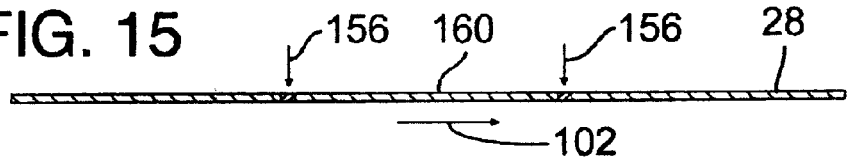
FIG. 15 is a side, cross-sectional view of the sheet of media in FIG. 14 taken along lines 15—15 in FIG. 14.

The incising fluid 150 is formulated to interact with the media 28 such that the media 28 is at least temporarily weakened where the incising fluid 150 is applied. Similar to using the printer to apply a line of ink on the media, the incising fluid 150 may be placed in a line on the media 28, thereby forming a score line or the like on the media. For example, as shown in FIG. 15, the incising fluid 150 may be placed along two spaced-apart parallel lines 156, thereby allowing the media 28 to be easily scored along the lines 156 for mailing the media 28 in an envelope or the like.

Also, where at least one other cartridge on the carriage is a printer cartridge, the printer can simultaneously print on the media 28 and incise the media 28 as the carriage 30 travels along its scanning axis 42.

Figure 16:
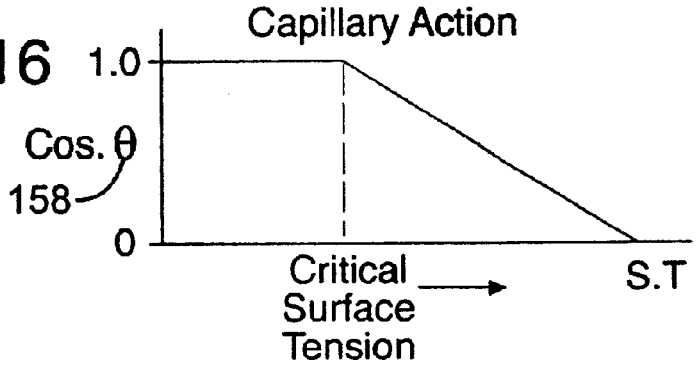
FIG. 16 is a chart showing a relationship between fluid surface tension and the wetting angle of the fluid on the surface it is exposed to which leads directly to the ease of penetration of the fluid into the media.
Figure 17:
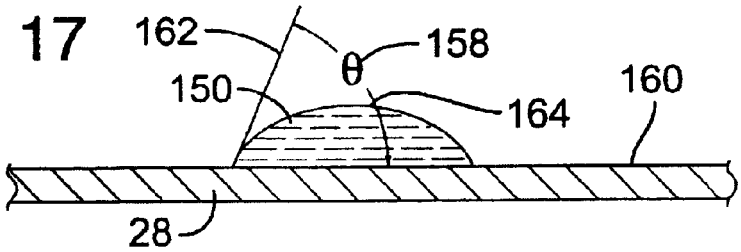
FIG. 17 is an exemplar drop of liquid on a sheet of media showing a possible geometry between the drop of liquid and the surface of the sheet of media.

Preferably, the incising fluid 150 is clear, not visible when applied to the media 28, and dries relatively quickly after the media 28 is scored along a created score line. More preferably and as best shown in FIGS. 16 and 17, the incising fluid 150 has a surface tension low enough to quickly penetrate the media 28, thereby creating a temporary or permanent weakening of the media 28.

Acceptable ranges of surface tension can be determined for a particular media 28 and incising fluid 150 combination by determining an angle theta 158. Angle theta 158 is defined as the angle between the media surface 160 and a line 162 tangent to the fluid-media interface point of the drop of incising fluid 150 as shown in FIG. 17. Referring to FIG. 16, for a given media 28 and incising fluid 150 combination, a desirable surface tension range of the incising fluid 150 can be found to assure desirable penetration into the media 28. The desirable surface tension range for the fluid is near the critical surface tension as shown in FIG. 16 such that the cosine of theta multiplied by the surface tension of the incising fluid 150 is maximized.

Where the media 28 is a sheet of regular bond paper, desirable surface tension for the incising media is preferably near 30 dines per centimeter. If the surface tension is substantially higher than 30 dines per centimeter, penetration of the incising fluid 150 is hindered by the cosine of theta approaching zero. Also, if the surface tension is substantially lower than 30 dines per centimeter, the product of cosine of theta times the surface tension is generally too low to provide sufficient penetration of the incising fluid 150. One known liquid having desirable properties for use as an incising fluid on paper is copying fixer, which is commonly used in printers, copiers, and the like. Preferably, a sufficient amount of incising fluid 150 is applied to the media to saturate through the media at the applied locations. Of course, the desirable surface tension of the incising fluid will vary depending on the particular media and incising fluid selected.

D. Alternative Embodiments

Having here described embodiments of the present invention, it is anticipated that other modifications may be made thereto within the scope of the invention by individuals skilled in the art. For example, a variety of different media engaging portions 48 can be operably secured to the incising head 82*a–d*. Similarly, a plurality of different incising devices and related actuators can be combined onto one carriage or even into one cartridge. In one embodiment, the same portions of the media may be both printed upon and incised. In another embodiment, different portions of the media may be printed upon and incised. Thus, although several different embodiments of the present invention have been described, it will be appreciated that the spirit and scope of the invention is not limited to those embodiments, but extend to the various modifications and equivalents as defined in the appended claims.

What is claimed is:

1. An incising device for incising media in a printer, the printer having a moveable carriage, said incising device comprising:

a frame configured to be operably secured to the carriage;

an incising head operably secured to the frame, the head including a plurality of mechanical incising structures, each structure being independently movable in a direction non-parallel to a plane of the media between a first position in which the structure engages the media to incise the media and a second disengaged position in which the structure is disengaged from the media;

at least one actuator operably secured to the incising head, said at least one actuator being configured to move each of the plurality of incising structures between the first position and the second position, wherein one of the mechanical structures includes a disk pivotally secured to the incising head, said disk operably engaging said media in said first position thereby incising the media.

2. The incising device for incising media in a printer of claim 1, wherein the incising device is configured to be detachably secured to the printer.

3. The incising device for incising media in a printer of claim 2, wherein the printer has a cartridge mount on the carriage, and further including a cartridge secured to said frame, said cartridge configured to be detachably secured to the cartridge mount.

4. The incising device for incising media in a printer of claim 1, wherein said carriage has a printing axis and said printer has a paper path substantially perpendicular to said printing axis, and wherein in said first position said incising head operably engages the media to incise the media in the direction of the printing axis and the direction of said paper path.

5. The incising device for incising media in a printer of claim 1, wherein said incising head operably engaging the media to incise the media is selected from the group consisting of a media cutter, a media scorer, a media perforator, and a media embosser.

6. The incising device for incising media in a printer of claim 1, wherein each incising structure is pivotally secured to said frame at a pivot axis.

7. The incising device for incising media in a printer of claim 1, wherein said first position includes a media incising position wherein said mechanical structure engages the media without cutting through the media, and a media cutting position wherein said mechanical structure cuts through the media.

8. The incising device for incising media in a printer of claim 1, wherein the carriage has a scanning axis, and said disk is aligned parallel to said scanning axis.

9. The incising device for incising media in a printer of claim 1, wherein said disk has a sharp outer diameter.

10. The incising device for incising media in a printer of claim 9, wherein said disk has a plurality of spaced-apart protrusions about the disk's outer diameter, said protrusions perforating the media in said first position.

11. The incising device for incising media in a printer of claim 1, wherein said disk has a concave outer diameter.

12. The incising device for incising media in a printer of claim 1, wherein said disk has a blunt outer diameter.

13. The incising device for incising media in a printer of claim 1, wherein said incising head is pivotally secured to said frame about a pivot axis and further including an incising head actuator operably secured to said frame and said incising head, said incising head actuator pivoting said incising head about said pivot axis thereby turning said disk about said pivot axis.

14. The incising device for incising media in a printer of claim 13, wherein said carriage has a printing axis and said printer has a paper path substantially perpendicular to said printing axis, and wherein said incising head operably engages the media in the direction of the printing axis and the direction of said paper path.

15. The incising device of claim 1, wherein the plurality of mechanical incising structures includes a second disk.

16. The incising device of claim 15, wherein the first disk and the second disk are parallel to one another.

17. The incising device of claim 15, wherein the first disk and the second disk are different from one another.

18. The incising device of claim 17, wherein the first disk has a continuous concave edge and wherein the second disk has a plurality of spaced-apart protrusions.

19. The incising device of claim 1, wherein at least one of the mechanical incising structures is movable between a cutting position in which the structure cuts through the media and a scoring position in which the structure partially cuts into the media.

20. The incising device of claim 1, wherein each of the plurality of incising structures pivot between the first position and the second position.

21. A printer for printing on and incising a sheet of media, the printer comprising:

a chassis;

a motor;

a carriage operably secured to the chassis and driven by the motor for reciprocal movement relative to the chassis;

a printhead operably secured to said carriage and in fluid communication with an ink reservoir; and, an incising device operably secured to said carriage, said incising device including a plurality of mechanical incising structures, each structure movable between an engaged position wherein the incising structure operably engages the media and a non-engaged position wherein the incising structure does not engage the media, wherein said incising device is pivotally secured to said frame at a pivot axis, and further including an incising device actuator operably secured to said frame and said incising device, said incising device actuator pivoting said incising device about said pivot axis.

22. The printer of claim 21, wherein the incising device is detachably secured to the printer.

23. The printer of claim 21, wherein said engaged position includes a media incising position wherein said mechanical structure engages the media without cutting through the media, and a media cutting position wherein said mechanical structure cuts through the media.

24. The printer of claim 21, wherein said mechanical structure includes a plurality of disks pivotally secured to the incising device, each disk of said plurality of disks spaced apart from the other disks of said plurality of disks and aligned substantially parallel to a scanning axis of the carriage, each said disk of said plurality of disks having a different media engaging portion.

25. The printer of claim 21, wherein the incising structure includes a disk and wherein pivoting of the device about the pivot axis turns said disk about said pivot axis.

26. The printer of claim 21, wherein said mechanical structure includes a plurality of pins operably extending from said incising device, each said pin being independently operable between said engaged and non-engaged positions.

27. The printer of claim 21 including a housing, wherein at least one of the mechanical incising structures projects from the housing in the first position and is retracted within the housing in the second position.

28. The printer of claim 27, wherein the housing comprises a case including the frame.

29. The printer of claim 28, wherein the case encloses the at least one actuator.

30. The printer of claim 21, wherein the plurality of mechanical incising structures includes a first disk and a second disk.

31. The printer of claim 21, wherein the plurality of structures includes a first disk and a second disk and wherein the first disk and the second disk are parallel to one another.

32. The printer of claim 21, wherein the plurality of structures includes a first disk and a second disk and wherein the first disk and the second disk are different from one another.

33. The printer of claim 32, wherein the first disk has a continuous concave edge and wherein the second disk has a plurality of spaced-apart protrusions.

34. The printer of claim 21, wherein at least one of the mechanical incising structures is movable between a cutting position in which the structure cuts through the media and a scoring position in which the structure partially cuts into the media.

35. The printer of claim 21, wherein each of the plurality of incising structures pivots between the first position and the second position.

36. The printer of claim 21, wherein said mechanical structure includes a plurality of different shaped blades extending from the incising device, each said blade being independently operable between said engaged and said non-engaged positions.

37. A printer for printing on and incising a sheet of media, the printer comprising:

a chassis;

a motor;

a carriage operably secured to the chassis and driven by the motor for reciprocal movement relative to the chassis;

a printhead operably secured to said carriage and in fluid communication with an ink reservoir; and, a incising device operably secured to said carriage, said incising device having an engaged position wherein the incising device operably engages the media and a non-engaged position wherein the incising device does not engage the media, said incising device commandable by a printer controller between said engaged and non-engaged positions thereby selectively incising the media, wherein said incising head is a mechanical structure that contacts the media in said first position, wherein said mechanical structure includes a plurality of disks pivotally secured to the incising head, each disk of said plurality of disks spaced apart from the other disks of said plurality of disks and aligned substantially parallel to a scanning axis of the carriage, each said disk of said plurality of disks having a different media engaging portion.

38. A printer for printing on and incising a sheet of media, the printer comprising:

a chassis;

a motor;

a carriage operably secured to the chassis and driven by the motor for reciprocal movement relative to the chassis;

a printhead operably secured to said carnage and in fluid communication with an ink reservoir; and, an incising device operably secured to said carriage, said incising device including a plurality of mechanical incising structures, each structure movable between an engaged position wherein the incising structure operably engages the media and a non-engaged position wherein the incising structure does not engage the media, wherein the incising device is detachably secured to the printer.

39. A printer for printing on and incising a sheet of media, the printer comprising:

a chassis;

a motor;

a carriage operably secured to the chassis and driven by the motor for reciprocal movement relative to the chassis;

a printhead operably secured to said carriage and in fluid communication with an ink reservoir; and, an incising device operably secured to said carriage, said incising device including a plurality of mechanical incising structures, each structure movable between an engaged position wherein the incising structure operably engages the media and a non-engaged position wherein the incising structure does not engage the media, wherein said mechanical structure includes a plurality of disks pivotally secured to the incising head, each disk of said plurality of disks spaced apart from the other disks of said plurality of disks and aligned substantially parallel to a scanning axis of the carriage, each said disk of said plurality of disks having a different media engaging portion.

* * * * *